United States Patent [19]

Riblet

[11] Patent Number: 4,708,336

[45] Date of Patent: Nov. 24, 1987

[54] MODULAR CONSTRUCTION ASSEMBLY FOR WALL OF COURT

[76] Inventor: Robert L. Riblet, 87 rue A. Laurent, F 94120 Fontenay Sous Bois, France

[21] Appl. No.: 700,889

[22] PCT Filed: May 3, 1984

[86] PCT No.: PCT/FR84/00122

§ 371 Date: Jan. 4, 1985

§ 102(e) Date: Jan. 4, 1985

[87] PCT Pub. No.: WO84/04255

PCT Pub. Date: Nov. 8, 1984

[30] Foreign Application Priority Data

| | | | |
|---|---|---|---|
| May 4, 1983 | [FR] | France | 83 07435 |
| Jan. 20, 1984 | [FR] | France | 84 00867 |
| Feb. 14, 1984 | [FR] | France | 84 02217 |

[51] Int. Cl.[4] ..... A63B 71/02

[52] U.S. Cl. ..... 272/3; 52/489; 52/714; 273/411

[58] Field of Search ..... 272/3; 52/486, 483, 52/474, 489, 762, 768, 772, 510, 79.1, 79.5, 79.9, 79.12, 79.13, 714; 273/411

[56] References Cited

U.S. PATENT DOCUMENTS

| | | | |
|---|---|---|---|
| 600,897 | 3/1898 | Siebold | 52/510 |
| 1,193,575 | 8/1916 | McFarland | 52/486 X |
| 3,185,267 | 5/1965 | Pavlecka | 52/483 X |
| 3,971,075 | 7/1976 | Heinbaugh et al. | 52/772 X |
| 3,998,018 | 12/1976 | Hodges | 52/489 X |
| 4,161,089 | 7/1979 | Omansky | 52/227 |

FOREIGN PATENT DOCUMENTS

| | | | |
|---|---|---|---|
| 3111982 | 10/1982 | Fed. Rep. of Germany | 272/3 |
| 968938 | 5/1950 | France . | |
| 1317814 | 1/1963 | France . | |
| 2122372 | 9/1972 | France . | |
| 2136943 | 12/1972 | France . | |
| 2457700 | 1/1981 | France | 272/3 |
| 7808358 | 2/1980 | Netherlands . | |
| 582291 | 11/1976 | Switzerland . | |
| 677220 | 8/1952 | United Kingdom | 52/489 |
| 1142217 | 2/1969 | United Kingdom | 52/483 |

*Primary Examiner*—Richard T. Stouffer

*Attorney, Agent, or Firm*—Oblon, Fisher, Spivak, McClelland, & Maier

[57] ABSTRACT

A reconstructable court for squash or similar sports, wherein court walls include an assembly of box-shaped modular panels including a bottom which is to be directed toward the inside of the court to form a part of the wall and an assembly flange of the panels and wherein at least a face directed toward the inside of the court is formed by a reinforced coating similar, in its composition, to a coating found on traditional courts. A method for applying a coating to the reconstructable court is also described.

7 Claims, 8 Drawing Figures

MODULAR CONSTRUCTION ASSEMBLY FOR WALL OF COURT

BACKGROUND OF THE INVENTION

1. Technical Field

The invention relates to the embodiment of courts for squash, racquetball or similar sports, and to modular constructions that can be used for playing these sports and for other purposes.

2. Background Art

A traditional squash court consists of masonry, generally of building blocks, extending on four sides to make a quadrilateral having the dimensions required for a squash court, and in which at least an access opening to the court delimited by this masonry is made. The masonry is coated on the inside with a monolayer coating generally made up of white cement and sand and reinforced with mineral fibers, the coating also containing a resin and additives. This combination of a coating having this composition with the masonry generally of building blocks, from the viewpoint of rebound of the ball and acoustic absorption, provides characteristics that have proved optimal, so that this structure is widely used in the playing of this sport. The ground is covered with a parquet floor.

Quite obviously it is understandable that such a court represents a stationary installation whose cost is relatively high.

It has already been proposed to make a reconstructable squash courts, making possible a relatively simple, less costly installation and giving the unit a character of relative mobility if the court, for certain reasons, has to be moved from one place to another.

Known embodiments of the applicant consist of a metal frame which acts as support to wood panels optionally combined with a coating.

However, while it is possible in this way to make a reconstructable squash court having the required dimensions at low cost, the characteristics obtained in regard both to the rebound of the ball and acoustic absorption differ widely from what is the case for a "traditional" squash court. Consequently, athletes engaging in this sport, in particular in competition, are hardly attracted by this embodiment which, on the one hand, affects the playing technique and, on the other hand, creates for the players a different ambience considering the resonances due to the modification of the acoustic effect resulting from the impact of the ball on the court walls.

DISCLOSURE OF INVENTION

One of the aims of the invention is to remedy these drawbacks of existing reconstructable squash courts and to create a reconstructable court providing playing characteristics similar to those encountered in traditional courts, while being both of simplified embodiment and lower cost and, as needed, making possible the mobility of the court thus embodied.

Consequently, the invention relates, according to a first aspect, to a reconstructable court for squash or similar sports, characterized in that the court walls consist of an assembly of box-shaped modular panels comprising a bottom intended to be directed toward the inside of the court to form a part of the wall and an assembly flange of the panels and of which at least the face directed toward the inside of the court is formed by a reinforced coating similar, in its composition, to the coating of traditional courts.

According to a preferred embodiment, the box-shaped panels consist entirely of a material whose composition is similar or analogous to that of the reinforced coating generally used as the inside coating in traditional squash courts.

As indicated above, this coating is made up of a mixture of white cement and sand reinforced with mineral fibers and containing at least a resin and additives. The mechanical strength of a material of this type, for a sufficient thickness, is perfectly suited for making reconstructable boxes that can be assembled with one another via their flanges to form the walls of a court.

The research which served as the basis for the invention showed that a suitable strength can be obtained where the panels are made from the above material and whose bottom and flanges have a thickness on the order of 10 mm, wherein the flanges themselves, intended for assembly of the panels, can have a height of 40 to 50 mm, for example.

According to a feature of the invention, to obtain an acoustic absorption comparable to that of a traditional court, the inside cavity of the boxes is filled with an acoustic absorbing material such as polystyrene or similar material.

The outside face of the panels, if desired, can receive a film or coating giving the unit a suitable appearance or finish.

It is understood that in this way it is possible to make from modular panels of given dimensions, for example on the order of 120×60 cm, a structure delimiting the four sides of a regulation court for squash or similar sport by a simple assembly of the panels with one another, thus obtaining a satisfactory structural strength.

The playing characteristics, namely the rebound of the ball and the acoustics, are, considering the nature of the structure of the boxes, similar to those obtained in the case of a traditional court.

To make this assembly of the box-shaped panels with one another possible, holes are advantageously provided, during production, in the flanges of the box-shaped panels, for the passage of assembly screws or similar means, which can particularly be of plastic. Recesses are then judiciously made at right angles to the screws in filling of the panel cavity to be able to have access to the screw heads and to the nuts for assembly.

As is known, a squash court comprises a higher end wall forming the front and a lower end wall or back of the court connected by side walls whose top then extends obliquely. To take this embodiment into account, several types of box-shaped modular panels are provided, according to the invention namely, standardized rectangular panels which form the bulk of the court walls and trapezoidal panels intended to form the upper parts of the side walls. A suitable determination of the dimensions of the box-shaped panels makes it possible to use a very small number of different trapezoidal panels to make the side walls, and normally two types of trapezoidal panels are sufficient. Rectangular finishing panels can also be used, if desired.

It can be seen from reading the above that the squash court can be built from a small number of modular panels of different types, which corresponds to a very efficient standardization, facilitating both production and assembly and resulting in a correspondingly reduced construction cost.

Further, considering this standardization of the box-shaped panels, the access opening to the inside of the court can be placed any place during construction, which facilitates installation of a self-carrying court of this type.

Because of said standardization of construction, it is also possible, according to another feature, to replace one or more panels with glass elements comprising, for example, a window fitted into a frame, particularly by gluing. These glass elements thus enable persons, such as spectators or watchmen on the outside to see inside the court.

The following arrangement according to the invention also allows the easy adaptation of a back wall or glass back wall, in a way known in the art in traditional courts, to enable spectators to watch the match.

As indicated, the arrangement, which is the object of the invention, is also applicable to courts intended for other sports having closely related rules, for example, racquetball. In this case, the four walls have the same height and are surmounted by a ceiling, for example of wood. Here again, glass elements and an access door can be provided at the desired places.

According to another feature of the invention, an outside metal reinforcement framework in combination with said structure made of assembled box-shaped panels is provided, if desired.

This metal framework can be made in a simple way from posts or uprights and horizontal bracing shapes assembled in any suitable manner. The posts and uprights are then judiciously distributed at right angles to the assembly joints between adjacent box-shaped panels, and can be joined to these box-shaped panels, for example, by stirrup-shaped half-collars going around the posts or uprights and the flanges of the panels and which are connected to the latter by screwing.

The structural unit thus made then exhibits great mechanical strength.

The dimensional stability or structural rigidity can be improved still more by providing, between two opposite sides of the metal framework, particularly between two side walls of the court, lower shapes or crosspieces acting as braces and opposing any variation in the distance between these sides of the metal framework. The resulting rigidity is then perfect. In this case, the floor of the court is installed on these lower shapes forming crosspieces. It will be noted in this regard that the arrangement according to the invention allows the installation of a parquet floor of any type, particularly of the official type.

According to another feature of the invention, the posts of the metal framework provided at the corners can also be extended upward for fastening a net above the court to keep the ball from going out in case of a bad rebound.

In the case of a court intended for racquetball, for example, these posts and uprights are also identical in height and act as support for the ceiling.

However, assembly of the modular panels of the court by bolting represents work that can be lengthy and requires significant manpower. Consequently, another aim of the invention is to create a construction by assembly of the modular panels remedying this drawback.

Moreover, it is known that use of modular panels in the construction field is very widespread because, thanks to the modularity, the time for performing the construction work can be kept within reasonable limits.

For example, thermal insulation on the outside is performed by fastening approximately flat and rectangular modular panels to boarding previously applied to the wall to be thermally insulated, glass wool having being placed between the boarding.

This invention according to another aspect, also has the aim of providing for a modular construction device of the type comprising approximately flat or box-shaped modular panels for partitioning, lining or covering structures which better meets the requirements of application than previously known devices of the same type, particularly in that:

assembly of the device is very fast;

the device can be disassembled, also very fast, without degradation, therefore with the possibility of reusing all the components.

According to another aspect, this invention therefore has as its object a modular construction device of the type comprising approximately flat or box-shaped modular panels, which are intended to constitute partitions, particularly for courts for squash or similar sports, or lining or outside covering walls of already existing constructions, particularly for thermal insulation on the outside; means for assembling said modular panels with one another; and means for fastening these panels to a carrying structure, particularly to a masonry wall or to a metal framework comprising uprights and crosspieces connecting consecutive uprights, said device being characterized in that said means for fastening the modular panels to said carrying structure consist of shapes parallel to one another and in the shape of a ⊔, which are made solid with the carrying structure by any suitable means, particularly bolting or other, and said means for assemblying said modular panels to one another consist of pieces comprising a first head, intended to be housed in the groove of each ⊔ shape and to be applied against the open side of this shape, and a second head in working connection with at least a pair of superposed modular panels, and a rod connecting these first and second heads.

According to an advantageous embodiment of the device, said approximately flat or box-shaped modular panels exhibit a groove or continuous slot which is made in the thickness of each approximately flat panel or of the flange of each box-shaped panel, all around the perimeter of said modular panels, and said second head is housed and locked between grooves or slots of at least a pair of superposed panels.

According to a preferred arrangement of this embodiment, said groove or continuous slot exhibits a cross section in the shape of a half-circumference and, in case the assembly relates to a single pair of superposed panels, said first and second heads of the assembly piece consist of two parallel cylindrical arms contained in the plane that goes through the connecting rod, while, in case the assembly relates to two adjacent pairs of superposed panels, said first head of the assembly piece consists of a cylindrical arm and the second head consists of a crosspiece with cylindrical arms, whose one arm is parallel to the first head and contained, together with this latter, in the plane that goes through the connecting rod, while the other arm is perpendicular to this plane, said second crosspiece head is placed at the point of junction between said two adjacent pairs of superposed panels.

According to an advantageous variant of this arrangement, said groove or continuous slot exhibits a cross section in the shape of a half-square and, in case the assembly relates to a single pair of superposed panels, said first and second heads of the assembly piece consist of two parallelepipedal arms, which are parallel to one another and contained in the plane that goes through the connecting rod, while, in case the assembly relates to two adjacent pairs of superposed panels, said first head of the assembly piece consists of a parallelepipedal arm and the second head consists of a crosspiece with parallelepipedal arms, whose one arm is parallel to the first head and is contained, together with the latter, in the plane that goes through the connecting rod, while the other arm is perpendicular to this plane, said second crosspiece head is placed at the point of junction between said two adjacent pairs of superposed panels.

According to another advantageous embodiment of the device, in case the modular panels are approximately flat, the second head of each assembly piece consists of a plate, particularly rectangular, which is perpendicular to the connecting rod with the first head and which is intended to be applied against the face of said modular panels which are on the side of said □ shapes, a pair of superposed panels or two adjacent pairs of superposed panels are made solid by screwing, with screws going through holes previously made in said panels and screwing into tapped holes made in each assembly plate, this latter being very close to said first head.

According to another advantageous embodiment of the device, a brace is wedged between each panel and is □ shaped to prevent vibrations.

According to an advantageous arrangement of this embodiment, this brace is pentagonal and exhibits a slot in the shape of a keyhole to snap around the connecting rod of said assembly piece.

Thus it is seen that embodiment of the construction from the elements or modular panels can thus be performed under quite improved and much faster conditions.

As indicated above, the construction of a court for squash, racquetball or the like from the modular panels can take place by using modular panels consisting of a material corresponding to the usual inside coating of such a court.

But it is also possible to make the modular panels from a different material. In this case, the face of the panels, directed inward after assembly, can receive a suitable coating.

Thus, it has recently been proposed for various applications, particularly for applying coatings in construction, to use a composition containing, by weight in dry material, from 20 to 60% by weight cement, from 30 to 70% an organic or mineral filler, from 2 to 10% zirconium silicate fibers, from 0.2 to 1% cement plasticizers, from 1 to 3% glue and from 0.1 to 0.5% a waterproofing agent. This composition, which makes possible the production of coatings and molded products, exhibits a good mechanical strength and is fluid-tight (as per FR Pat. No. 2 432 489). Such is marketed under the name "CRIDOFIBRE" (CIDE Company, Paris).

Tests made by the applicant showed that the characteristics of this composition are suitable for use to apply coatings to walls for courts for squash, racquetball, or similar sports, particularly in regard to the the rebound properties of the ball and acoustic absorption properties.

However, it appeared during these tests, on the one hand, that the very nature of the coating thus used, because of its surface structure, causes a premature wear of the balls and, on the other hand, the balls leave on the coating surface, during their impact and rebound, traces that then can not be removed by washing, for example. Consequently, it turns out that the walls of a court thus made very quickly become dirty as a result of the multiplicity of dark or even black traces left by the balls during their impact, and the resulting appearance is thus unacceptable.

Another aim of the invention is to remedy this drawback for this particular application, whether the courts are made in the "traditional" way or from modular panels.

Another drawback of this type of coating charged with fibers resides in the fact that the resulting surface appearance suffers from this presence of visible fibers on the surface, whose distribution in the coating is obviously irregular.

Another object of the invention is also to remedy this drawback.

The invention therefore, according to still another aspect, relates to an embodiment of courts for squash, racquetball or similar sports, of the type in which the court walls are provided with an inside coating applied after construction of the court in the case of traditional courts, or else provided on the elements, particularly the prefabricated panels, during construction of a court, characterized in that there is first applied to these walls or these elements a coating of a composition containing, by weight in dry material, from 20 to 60% cement, from 30 to 70% organic or mineral filler, from 2 to 10% zirconium silicate fibers, from 0.2 to 1% cement plasticizers, from 1 to 3% glue and 0.1 to 0.5% of a waterproofing agent, then after this coat dries, there is applied to it a thin finishing layer of lacquer or synthetic resin.

This lacquer can advantageously be of the acrylic or vinyl type, or else of an equivalent type.

According to a preferred mode of use, there is first applied to the inside walls of the constructed court or to the faces of the elements, particularly panels, intended to be directed toward the inside of the court, a coating having the composition indicated, and then on the free face of this coating, before application of the finishing layer of lacquer or resin, a coating layer having said composition but from which the fibers have been eliminated.

The coating applied according to the invention can have a thickness of 7 to 10 mm, for example, and can be covered with a very thin layer of lacquer, applied for example, by brush, spraying or in any other desired manner. During use of an additional layer not charged with fibers, this layer can have a thickness, for example, of 1 to 2 mm.

The process according to the invention benefits from the advantages resulting from the nature and properties of the base coating having the composition indicated, particularly in regard to the characteristics of rebounding of the ball and acoustic absorption. But the thin finishing layer formed by the lacquer provides the possibility, without harming said properties, of removing all traces of the impact of the balls by washing, so that the court walls keep a clear and clean appearance, valued by players and necessary particularly in the case of competition sport. This result is obtained, as indicated above, without modification of the mechanical properties of the inside surfaces of the court walls. Thus it was able to be established that this thin layer of finishing lacquer does not modify the pinpoint character, free of sliding of the impact of the balls rebounding on the coating and avoids premature wear of the balls. It was also found that the bond of this lacquer in a finishing layer to the base coating is excellent and that no film peeling occurs.

During use of the process in its preferred form, by using a fiber-free intermediate layer, the surface appearance of the coating is then perfectly uniform and said drawback, resulting from the appearance of fibers on the surface, is avoided. This result is obtained without harming the properties of the coating, particularly if the thickness of the layer not charged with fibers is slight relative to the thickness of the base coating, as indicated above.

There are numerous lacquers and synthetic resins, particularly acrylic and vinyl resins, that can be applied to supports or substrates to form the finishing layer, and one skilled in the art can easily select a lacquer, from those products available on the market, which does not peel under the effect of the impact of the balls during playing the sport in question.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

BEST MODES FOR CARRYING OUT THE INVENTION

Figure 1:
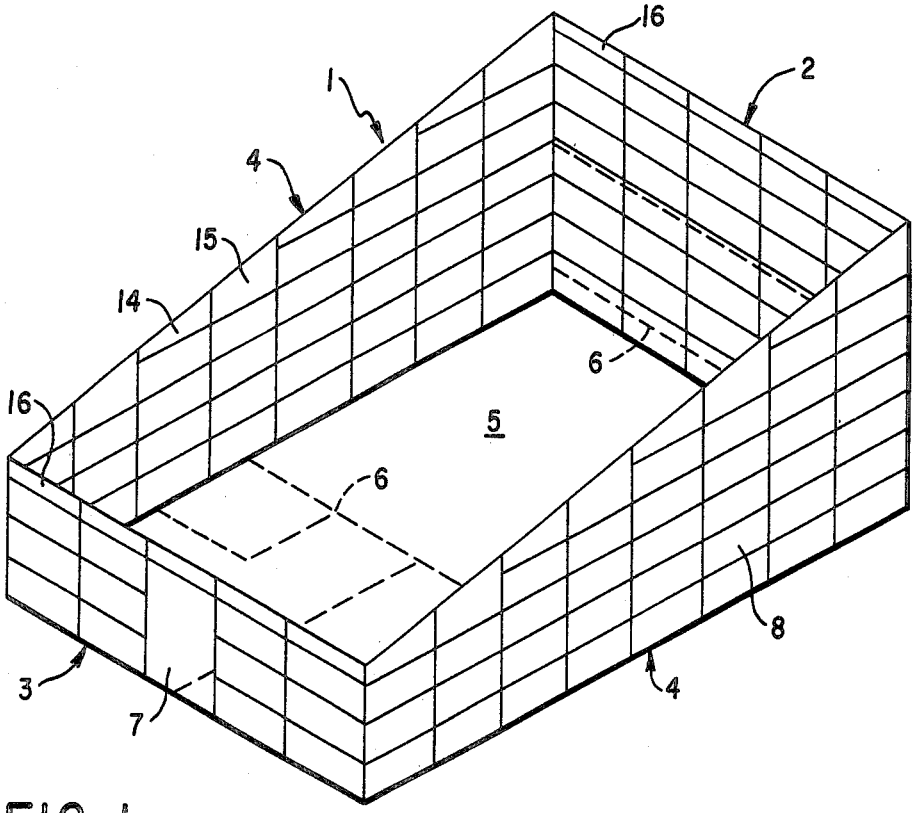
FIG. 1 is a representation in perspective of a self-carrying squash court embodied according to the invention.

FIG. 1 shows diagrammatically in a perspective view a squash court designated in its entirety as reference 1, whose walls, namely front 2, back 3 and sides 4 are embodied by assembly of box-shaped modular panels as described below. The court is made according to regulation dimensions known in the art, and comprises a floor 5 on which are indicated by dotted lines 6, the playing lines, these latter also being carried on the lower face of front 2 as can be seen in the drawing. The court access door is diagrammatically indicated by reference number 7.

Figure 2:
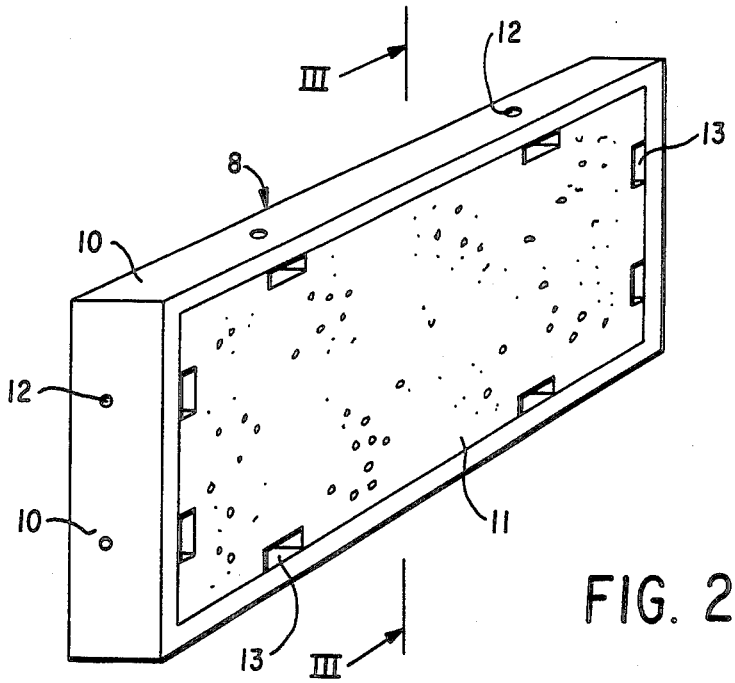
FIG. 2 is a view in perspective of a rectangular box-shaped modular panel used to embody the court according to the invention.
Figure 3:
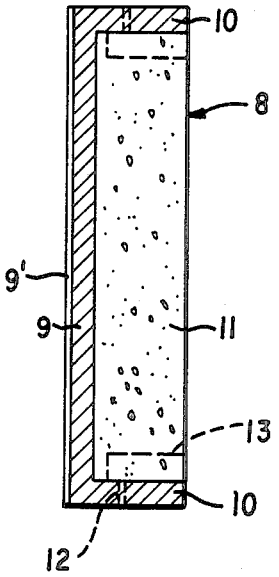
FIG. 3 is a plan view along line III—III in FIG. 2.

Reference is now made to FIGS. 2 and 3 which show in greater detail a box-shaped modular panel that can be used for embodying the self-carrying court according to the invention.

The panel shown in FIGS. 2 and 3 is designated in its entirety by reference 8. It has a box shape and comprises a bottom 9 and a peripheral flange 10. In this case, bottom 9 and flange 10 consist of a unitary material whose composition is similar to that of the coating normally used in making traditional squash courts, i.e., this material is made of white cement and sand, reinforced with mineral fibers, and also containing at least a resin and additives.

According to a variant, the box-shaped panels could also be of a different material, for example, of a cement of a different nature, and be provided on the face of their bottom 9 directed toward the inside of the court with a monolayer coating 9' of said composition, similar to the coating used in traditional courts.

In the case of the embodiment considered, bottom 9 and flanges 10 of each modular panel 8 have a thickness on the order of 10 mm, and the flanges have a height on the order of 40 mm. Actually, it has been found that, considering the nature of the material, these dimensions provide sufficient mechanical strength for an embodiment of a self-carrying structure having the dimensions of a squash court.

To obtain suitable acoustical characteristics, comparable to those of a traditional court, the cavity made by flange 10 of each panel 8 is filled with a filling material 11, which, for example, can be of polystyrene.

FIG. 2 shows holes 12 made in flanges 10 of panel 8 for the passage of assembly screws, particularly of plastic. Also recesses 13 are provided in filling 11 to allow access to the screw heads or nuts for assembly.

The panel shown in FIGS. 2 and 3 is a rectangular panel that can have dimensions on the order of 120×60 cm. As appears from an examination of FIG. 1, it can be used to constitute the major part of the squash court walls. The standardization thus achieved makes it possible, by suitable placement, to provide court access door 7 at any location in the walls, depending on the placement of the squash court in a group of sports installations, for example.

The court is completed, considering the difference in dimensions between front 2 and back 3, by trapezoidal panels forming an oblique upper edge for side walls 4. Examination of FIG. 1 shows that, by a suitable selection of the dimensions of the panels, a court can be embodied by using, besides the standardized rectangular panels 8, two types of standardized trapezoidal box-shaped panels 14, 15, which are alternately placed at the top of the court side walls. Finally, it can be seen in FIG. 1, in the case of the embodiment in question, that rectagular panels 16 of less height are provided at the top of the two opposite walls 2 and 3 forming the front and back of the court. Thus, the entire court can be embodied from a small number of types of different standardized box-shaped panels, which here total four.

Figure 4:
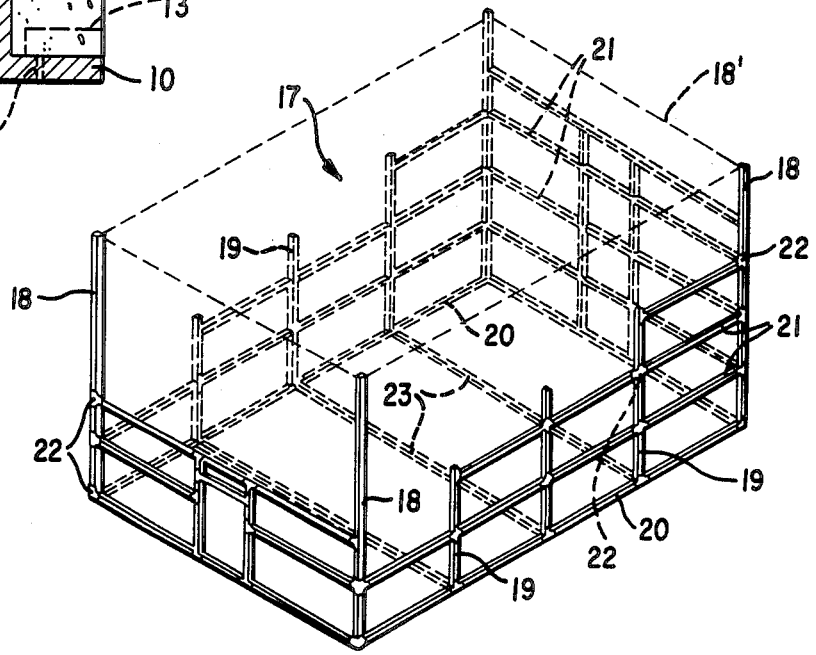
FIG. 4 is a view in perspective showing a metal framework that can be used to reinforce the self-carrying court according to the invention.

FIG. 4 shows diagrammatically in perspective a metal framework which, if desired, can be provided around the squash court embodied with the panels assembled as indicated above, for reinforcement and to increase rigidity, for example, for resistance to the wind.

As indicated, the metal framework shown, which is designated in its entirety by reference 17, comprises corner posts 18 and intermediate uprights 19, which can consist of pipes with a square cross section, for example. These posts 18 and these uprights 19 are joined at their base and at different heights by shapes 20, 21 which can consist, for example, of pipes with a flattened cross section. Assembly pieces 22 are provided at the assembly points, as indicated diagrammatically. These pieces have not been shown in detail since their embodiment is within the scope of any technician familiar with metal frameworks. The metal framework is designed for making an opening corresponding to court access opening 7, provided in the walls formed by the assembled box-shaped panels.

FIG. 4 indicates lower crosspieces 23 that connect two lower shapes 20 of the side walls to one another to maintain a suitable distance between them and thus increase the structural rigidity of the unit. Floor 5 of the court is then laid on these crosspieces 23.

It can be seen in FIG. 4 that corner posts 18 have an increased height, particularly in the part corresponding to the back of the squash court. This makes it possible to fasten a net 18' between their tops to keep the ball from being thrown or hit out of the court.

Figure 5:
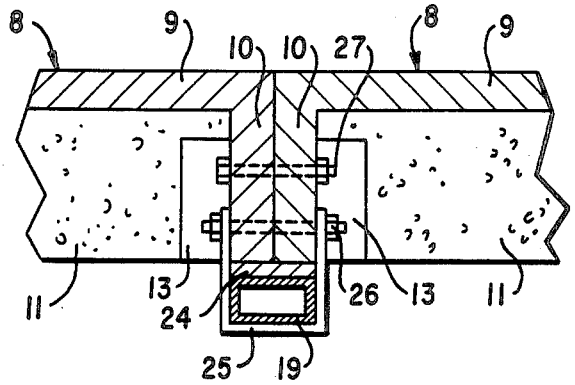
FIG. 5 is a detailed view showing the method of assembly of a member of the metal framework, with the box-shaped panels.

FIG. 5 shows in detail the manner in which outside metal framework 17 can be joined to box-shaped panels 8 to reinforce the unit. An intermediate upright is designated by 19 and is placed parallel to a joint between two box-shaped panels 8. A rubber gasket 24 is then placed between the edge of flanges 10 of the assembled panels and upright 19. Assembly is performed by a stirrup-shaped half-collar 25 which is fitted around upright 19 and whose arms are positioned within recesses 13 made in fillings 11 of box-shaped panels 8 to surround adjacent flanges 10.

In this case, additional assembly holes are provided in these flanges for passage of the assembly screws 26. The normal panel assembly screws 27 are indicated in FIG. 5.

It can be seen that the construction of a squash court of the type that is the object of the invention can be embodied at a clearly lower cost in comparison with that of a traditional court, considering the fact that it consists of the assembly of modular panels by simple screwing. This advantage is obtained without having to sacrifice the technical characteristics of such a court, in regard both to the game itself and the acoustic conditions in which the players move on the interior of the court.

The construction, which is the object of the invention, also makes possible, if desirable or necessary, disassembly of the court and its transfer to another site, which can also represent an important advantage, if only, for example, during a modification of the arrangement in a sports complex.

Figure 6:
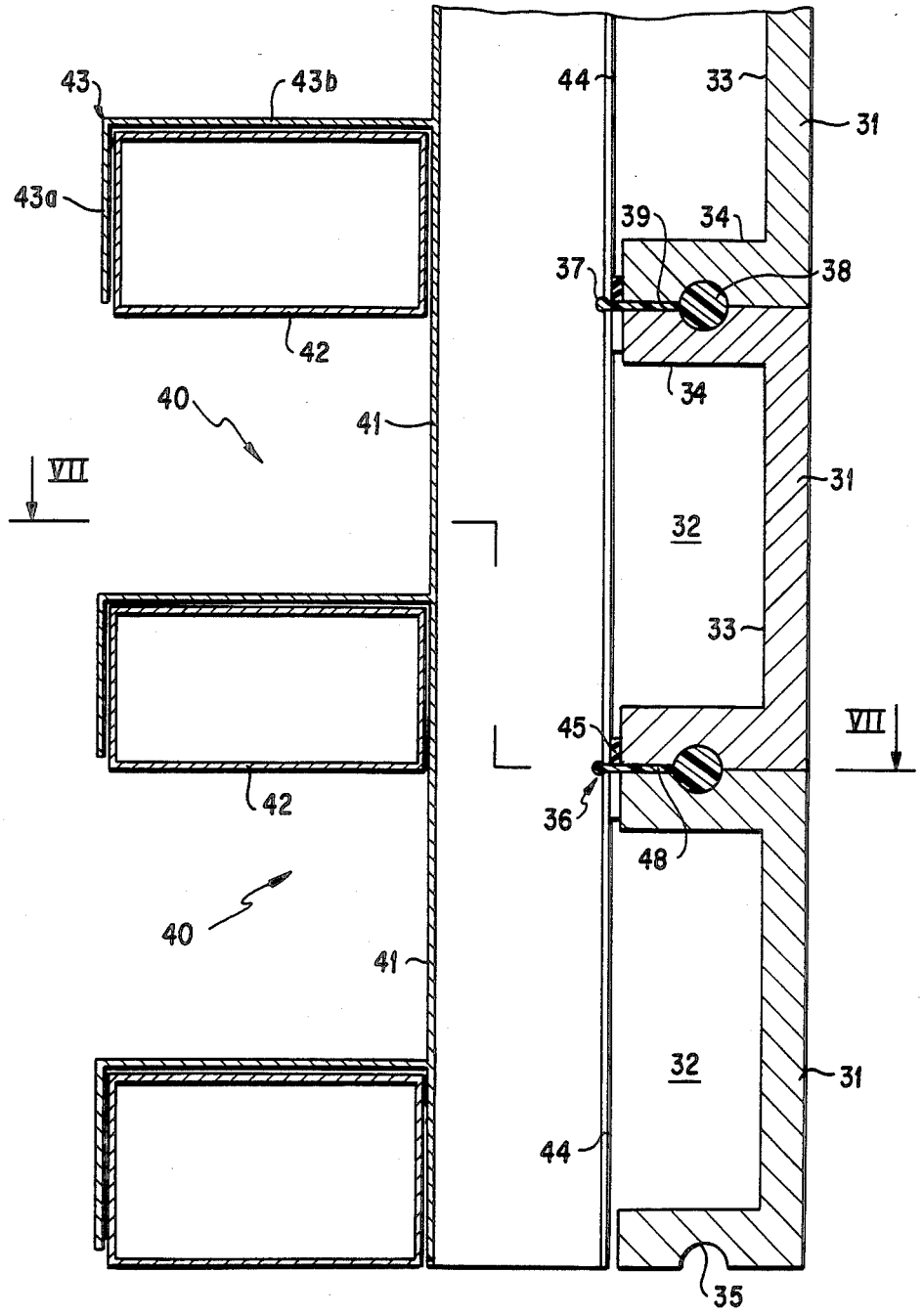
FIG. 6 shows a vertical section of a modular construction device for squash, racquetball or similar sports, showing the assembly of box-shaped modular panels by assembly pieces according to the invention, and their fastening to the crosspieces of a carrying metal framework with the aid of ⊐ shapes, according to the invention.
Figure 7:
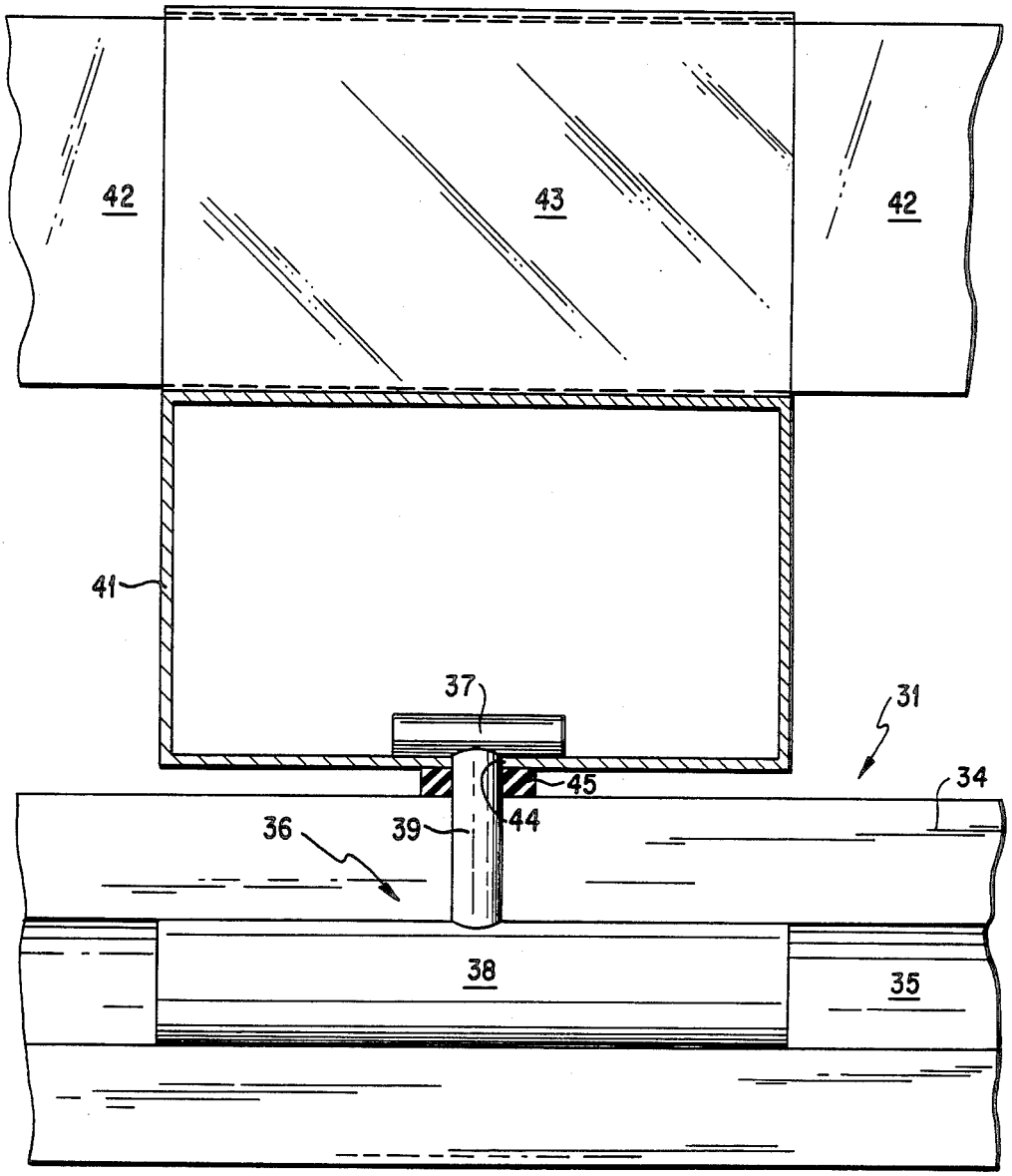
FIG. 7 is a horizontal section taken along line VII—VII in FIG. 6.
Figure 8:
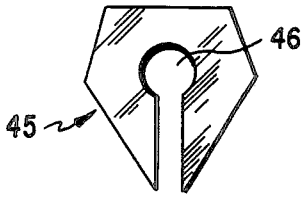
FIG. 8 is a representation in front elevation of a brace according to the invention.

Reference will now be made to FIGS. 6 to 8, which relate to the construction of a squash court or the like from modular panels whose assembly is embodied according to another aspect of the invention.

FIG. 6 shows box-shaped modular panels 31 which are made by molding of a coating whose composition is, for example, similar to that of a coating for traditional courts, namely, comprising a mixture of white cement and sand, which is reinforced with mineral fibers and contains a resin and suitable additives.

Space 32, delimited between bottom 33 and flange 34 of each box-shaped panel 31, is empty in its representation in FIG. 6, however, this space 32 can be filled with a suitable acoustic absorption material, such as polystyrene, or any other material, depending on the particular application envisaged.

Each box-shaped panel 31 exhibits a groove or slot 35 which is made continuously in the thickness and on the four sides of flange 34 and an additional groove or slot 48 transversely oriented with respect to slot 35. This groove 35, made during molding, has a cross section which preferably has the shape of a semi-circumference, however, other shapes are possible, particularly the shape of a half-square or other desired shape.

Connection of two superposed box-shaped panels 31 is done with a piece 36, which comprises a first cylindrical head 37 and a second cylindrical head 38 which are connected by a rod 39, also cylindrical, contained in the plane going through the two heads 37 and 38 parallel to one another. Head 38 is intended to be housed and locked between the parallel and opposite horizontal portions of grooves 35 of said two superposed panels 31. If the groove has a half-square shape, the heads are shaped with parallelepipedal arms.

Pieces 36 can be made of a metallic material or, advantageously, of any suitable plastic exhibiting good mechanical strength.

The number of assembly pieces 36 used between two superposed modular panels 31 is a function of the dimensions of the latter: in particular, it is possible to have this piece 36 in correspondence with the ends of a first pair of superposed panels 31, namely, the junction between a second and a third adjacent pairs of superposed panels 31 which are on both sides in relation to this first pair, but of course between the end assembly pieces it is possible to use more than one intermediate assembly piece. Further, in some cases, it may be advantageous not to use assembly pieces at the junction points between two adjacent pairs of modular panels 31 superposed two by two, but to use only intermediate assembly pieces.

When end assembly pieces 36 are used, they can advantageously comprise a second head in the shape of a crosspiece (not shown) with cylindrical arms, if grooves 35 exhibit a cross section in the shape of a half-circumference, or parallelepipedal arms if said grooves exhibit a cross section in the shape of a half-square: the horizontal arm of the crosspiece is housed and locked between the horizontal portions of grooves, parallel and opposite in pairs, of two adjacent pairs of superposed box-shaped panels, while the vertical arm of the crosspiece is housed and locked between the vertical portions, parallel and opposite in pairs, of said two adjacent pairs of superposed box-shaped panels.

The two vertical portions and the two horizontal portions of the continuous peripheral grooves 35 can advantageously exhibit different widths, the width of the horizontal portions being greater than the width of the vertical portions, which implies that the perpendicular arms of each crosspiece can also exhibit a different thickness.

The possibility of making vertical grooves of different width in relation to that of the horizontal grooves can be advantageous during molding of box-shaped panels 31. Actually, it suffices to place in the mold two parallel rods of circular or square cross section corresponding to the horizontal grooves, and two other parallel rods perpendicular to the first rods and respectively cylindrical or parallelepipedal, of less thickness, intended to be slipped into the holes of the first pair of parallel rods and corresponding to the vertical grooves. Therefore, these vertical grooves, which serve for visually observing the alignment when the various modular panels are put in place, can also be used to improve the assembly at the junction points between two adjacent pairs of superposed panels.

Box-shaped modular panels 31, assembled with the aid of said assembly pieces 36, are made integral with a carrying structure 40, consisting particularly of a metal framework, made by means of ⊐ shapes 41 or C-shaped frame fastened by any suitable means, particularly by bolting or other, to crosspiece 42 of this metal framework 40.

The figures represent in particular a nonlimiting mode of fastening of a shape 41 comprising angle irons 43, whose one arm **43*b* is welded to shape 41 and is applied on a crosspiece 42, while the other arm 43*a* strikes against this crosspiece 42**.

The open side of the ⊐ shape is directed toward box-shaped panels 31, to introduce said first cylindrical head 37 of each assembly piece 36 on the inside of shape 41 through opening. For this purpose the diameter of head 37 is slightly less than the width of this opening 44, so that this head 37 can be introduced vertically on the inside of shape 41 and applied against its inside wall by a 90° rotation.

FIG. 7 shows that first head 37 of each assembly piece 36 advantageously exhibits length less than that of second head 38, since essentially head 37 is intended to come into striking contact against the inside wall of shape 41.

To prevent vibrations, a separation brace 45 is wedged, with gentle force, between shape 41 and panels 31. Advantageously this brace 45, which is made of stiff rubber, PVC or other, exhibits a pentagonal configuration and a radial slot 46 in the shape of a keyhole to snap around the rod of each assembly piece 36.

Of course, in regard to the correct placing of the lower, horizontal row of modular panels supporting the upper rows, the ground must previously be leveled around the base of the modular construction device according to the invention by any suitable means.

Application of the fastening system according to the invention, which uses ⊐ shapes, also makes it possible to simply the construction of adjacent courts for squash or similar sports by using a single metal support wall common to two adjacent courts.

Although the system for interconnecting the various modular panels provided with a continuous peripheral groove, and the system for fastening a carrying structure of assembled panels has been described with reference to a reconstructable court for squash or racquetball or similar sports, said assembly and fastening systems are, of course, also applicable to achieving thermal insulation on the outside. In this case, the carrying structure against which the ⊐ shapes are applied consists of the masonry walls of the construction to be insulated, and the empty space 32, between the bottom 33 and flange 34 of each box 31, can be filled with an insulating material, such as glass wool. The heat bridges at the junction between two superposed panels 31, which are due to the clearance existing on the side of shapes 41, on both sides in relation to rod 39 of each assembly piece 36, can be eliminated by filling this clearance with insulating foam, which can be applied during mounting of the device according to the invention or glued to each panel 31 when it is produced. Another possible application consists in the construction of floors, but in this case said braces 45 are not used.

Further, in case approximately flat modular panels are used, it can be advantageous, in some applications, not to make said continuous groove around the perimeter of each panel, and to use, as means of assembling the various panels, an assembly piece whose second head consists of a plate, particularly rectangular (not shown), which is perpendicular to the rod for connecting with the first head and which is intended to be applied against the face of said modular panels which are on the side of said ⊐ fastening shapes. In this case, a pair of superposed panels or two adjacent pairs of superposed panels are made integral by screwing, with screws going through holes previously made in said panels and screwing in tapped holes made in each assembly plate. Of course, the connecting rod between this plate and the first head of each assembly piece, in this case, is advantageously very short, i.e., each plate is very close to said first head intended to be housed in the groove of a ⊐ shape 41.

It is obvious that, regardless of the contemplated application of the modular construction device according to the invention, its indisputable advantage consists in the fact that it can be disassembled without degradation of the materials used, namely, with the possibility of reusing them, while making possible very fast execution of the work and, in any case, much faster than with previously known modular construction devices.

The advantage of being able to be disassembled can be appreciated, in particular, during temporary modification of certain spaces by creating of a partition system delimiting the areas intended for different uses during a period that is limited but long enough to justify such an intervention so that the condition of the premises can be restored to its original configuration.

Obviously, the nature of the materials used depends on the different applications and, instead of said coating for traditional squash courts, wood or other material can be used. As comes out from the above, the invention is in no way limited to the embodiments and applications that have just been described more explicitly; on the contrary, it takes in all variants that can come to the mind of a technician on the subject, without going outside the framework or scope of the invention.

What is claimed is:

1. A modular construction assembly for a wall of a court, comprising:

a support framework structure including a plurality of upright members and a plurality of crosspiece members interconnecting consecutive ones of said upright members;

a plurality of modular box-shaped panels each having first and second flanges, said flanges each having first and second longitudinal grooves formed therein, said first and second grooves being transversely oriented with respect to each other, said first and second grooves being aligned with ones of said first and second grooves of adjacent ones of said flanges in adjacent ones of said panels when assembled; and means for fastening said modular panels to said support framework structure wherein said means for fastening the modular panels to said support framework structure comprises a plurality of connecting members oriented parallel to one another, positioned in said first and second aligned grooves of said flanges of said modular panels and which are connected to said support framework structure and wherein each said connecting member comprises a first head insertable in said support framework structure, a second head positioned in said first aligned grooves, and a rod connecting said first and second heads and positioned in said second aligned grooves.

2. An assembly as set forth in claim 1, wherein said first aligned grooves have a cross section in the shape of a half-circumference, and said first and second heads of the connecting members further comprise first and second parallel cylindrical arms.

3. An assembly as set forth in claim 1, wherein said second aligned grooves have a cross section in the shape of a half-circumference, and said first head of the connecting members comprises a first cylindrical arm and the second head comprises a second cylindrical arm, which is parallel to the first cylindrical arm and is contained in a plane which passes through the connecting rod.

4. An assembly as set forth in claim 1, further comprising a brace wedged between end portions of each of said flanges of each of said modular panels and said support framework structure.

5. An assembly as set forth in claim 4, wherein said brace has a radial slot formed therein in the shape of a keyhole and within which said connecting rod is positioned.

6. Device as set forth in claim 4, wherein said brace is of a pentagonal shape.

7. An assembly as set forth in claim 1, wherein the upright members of said support framework structure comprise C-shaped members; and a plurality of angle irons having one arm welded to the C-shaped members and a second arm of said angle irons is connected to said plurality of cross-piece members.

* * * * *